US012808156B2

(12) United States Patent
Li et al.

(10) Patent No.: US 12,808,156 B2
(45) Date of Patent: Nov. 24, 2026

(54) BULLDOZING HYDRAULIC SYSTEM WITH BULLDOZING BLADE FLOATING FUNCTION AND EXCAVATOR

(71) Applicant: Xuzhou XCMG Excavator Machinery Co., Ltd., Jiangsu (CN)

(72) Inventors: Jinpeng Li, Jiangsu (CN); Zhike Song, Jiangsu (CN); Yueji Liu, Jiangsu (CN); Liguo Ma, Jiangsu (CN); Fei Zhang, Jiangsu (CN); Rongbiao Wang, Jiangsu (CN); Suhua Yue, Jiangsu (CN); Fuli Shang, Jiangsu (CN); Saisai Pan, Jiangsu (CN); Haicheng Wang, Jiangsu (CN); Pengkun Zhao, Jiangsu (CN)

(73) Assignee: Xuzhou XCMG Excavator Machinery Co., Ltd., Jiangsu (CN)

( * ) Notice: Subject to any disclaimer, the term of this patent is extended or adjusted under 35 U.S.C. 154(b) by 319 days.

(21) Appl. No.: 18/705,596

(22) PCT Filed: Aug. 15, 2022

(86) PCT No.: PCT/CN2022/112360
§ 371 (c)(1),
(2) Date: Apr. 29, 2024

(87) PCT Pub. No.: WO2023/071417
PCT Pub. Date: May 4, 2023

(65) Prior Publication Data

US 2026/0160045 A1 Jun. 11, 2026

(30) Foreign Application Priority Data

Oct. 29, 2021 (CN) ..... 202111268901.5

(51) Int. Cl.
*E02F 9/22* (2006.01)
*E02F 3/84* (2006.01)

(52) U.S. Cl.
CPC ..... *E02F 9/2203* (2013.01); *E02F 3/844* (2013.01)

(58) Field of Classification Search
CPC ..... E02F 3/844; E02F 9/2203; E02F 9/2004; E02F 9/226; E02F 9/2285; F15B 2211/7741
See application file for complete search history.

(56) References Cited

U.S. PATENT DOCUMENTS 3,997,007 A * 12/1976 Junck ..... E02F 9/2004 60/486
4,201,268 A * 5/1980 Frisbee ..... E02F 3/7613 172/812

(Continued)

FOREIGN PATENT DOCUMENTS

CN 101922162 12/2010
CN 103939403 7/2014

(Continued)

OTHER PUBLICATIONS

"International Search Report (Form PCT/ISA/210) of PCT/CN2022/112360," mailed on Dec. 2, 2022, with English translation thereof, pp. 1-4.

*Primary Examiner* — Christopher J Sebesta
*Assistant Examiner* — Blake E Scoville
(74) *Attorney, Agent, or Firm* — JCIPRNET

(57) ABSTRACT

A bulldozing hydraulic system with a bulldozing blade floating function and an excavator comprises a load-sensitive pump, a bulldozing blade oil cylinder, a load-sensitive valve and a station switching mechanism. The load-sensitive valve comprises a four-position reversing valve. When the four-position reversing valve is at a first station, oil enters a small-cavity A port of the bulldozing blade oil cylinder and returns from a large-cavity B port, and a bulldozing blade is controlled to ascend; when the four-position reversing valve (Continued)

is located at a second station, oil enters the large-cavity B port of the bulldozing blade oil cylinder and returns from the small-cavity A port, and the bulldozing blade is controlled to descend; and when the four-position reversing valve is at a third station, the small-cavity A port and the large-cavity B port of the bulldozing blade oil cylinder are communicated with an oil tank.

6 Claims, 4 Drawing Sheets

(56) References Cited

U.S. PATENT DOCUMENTS

| | | | | | |
|---|---|---|---|---|---|
| 4,770,083 | A * | 9/1988 | Johnson | F15B 11/08 | 91/461 |
| 5,426,874 | A * | 6/1995 | Nakata | E02F 3/844 | 74/471 XY |
| 5,907,991 | A * | 6/1999 | Ramamoorthy | E02F 9/2203 | 91/450 |
| 2015/0315768 | A1* | 11/2015 | Jeong | E02F 9/2292 | 60/426 |
| 2016/0251830 | A1* | 9/2016 | Son | F15B 11/028 | 60/445 |
| 2017/0114523 | A1* | 4/2017 | Horstman | E02F 9/2087 | |
| 2018/0371720 | A1* | 12/2018 | Jewell | E02F 3/7631 | |

FOREIGN PATENT DOCUMENTS

| | | | |
|---|---|---|---|
| CN | 113882444 | | 1/2022 |
| JP | 2009019408 | | 1/2009 |
| JP | 2009019408 | A * | 1/2009 |
| JP | 2009155893 | | 7/2009 |

* cited by examiner

BULLDOZING HYDRAULIC SYSTEM WITH BULLDOZING BLADE FLOATING FUNCTION AND EXCAVATOR

CROSS-REFERENCE TO RELATED APPLICATION

This application is a 371 of international application of PCT application serial no. PCT/CN2022/112360, filed on Aug. 15, 2022, which claims the priority benefit of China application no. 202111268901.5, filed on Oct. 29, 2021. The entirety of each of the above mentioned patent applications is hereby incorporated by reference herein and made a part of this specification.

TECHNICAL FIELD

The invention relates to the field of hydraulic techniques for engineering machines, in particular to a bulldozing hydraulic system with a bulldozing blade floating function and an excavator.

BACKGROUND

The continuous upgrading and updating of hydraulic systems of excavators lead to the pursuit of innovation and diversification in design of the hydraulic systems. Some excavators are provided with a bulldozing blade to realize quick bulldozing and leveling. The bulldozing blade of excavators on the present market is controlled to ascend and descend by stretching and retraction of a bulldozing blade oil cylinder, and the bulldozing blade in such a bulldozing hydraulic system does not have a floating function and has low efficiency when used for trench backfilling and field leveling.

BRIEF SUMMARY OF THE INVENTION

The purpose of the invention is to provide a bulldozing hydraulic system with a bulldozing blade floating function and an excavator to solve the problem that the bulldozing blade of existing excavators does not have a floating function.

The above technical purpose of the invention is fulfilled by the following technical solution:

To fulfill the above purpose, the invention adopts the following technical solution:

The invention provides a bulldozing hydraulic system with a bulldozing blade floating function, comprising a load-sensitive pump, a bulldozing blade oil cylinder, a load-sensitive the load-sensitive valve comprises a four-position reversing valve;

the four-position reversing valve at least has a first station, a second station and a third station which are switchable;

when the four-position reversing valve is at the first station, a port P of the load-sensitive pump is communicated with a small-cavity A port of the bulldozing blade oil cylinder, a large-cavity B port of the bulldozing blade oil cylinder is communicated with an oil tank, oil enters the small-cavity A port of the bulldozing blade oil cylinder and returns from the large-cavity B port, and a bulldozing blade is controlled to ascend;

when the four-position reversing valve is at the second station, the port P of the load-sensitive pump is communicated with the large-cavity B port of the bulldozing blade oil cylinder, the small-cavity A port of the bulldozing blade oil cylinder is communicated with the oil tank, oil enters the large-cavity B port of the bulldozing blade oil cylinder and returns from the small-cavity A port, and the bulldozing blade is controlled to descend;

when the four-position reversing valve is at the third station, the small-cavity A port and the large-cavity B port of the bulldozing blade oil cylinder are communicated with a port T of the load-sensitive valve, and the small-cavity A port and the large-cavity B port of the bulldozing blade oil cylinder are communicated with the oil tank, such that a bulldozing blade floating function is realized;

the station switching mechanism is configured to select and switch the stations of the four-position reversing valve according to load pressure feedback or a handle signal output.

Further, the station switching mechanism comprises a bulldozing pilot valve, a port 1 and a port 2 of the bulldozing pilot valve are communicated with a port a and a port b of the four-position reversing valve respectively;

when a pilot pressure is controlled to be at a first stage which is between 0 and an ultimate positioning set value, pilot oil enters the port b via the port 1 of the bulldozing pilot valve to push a valve spool of the four-position reversing valve to move leftwards, the four-position reversing valve is at the second station, at this moment, oil enters a large cavity of the bulldozing blade oil cylinder and returns from a small cavity, and the bulldozing blade is controlled to descend;

the pilot oil enters the port a via the port 2 of the bulldozing pilot valve to push the valve spool of the four-position reversing valve to move rightwards, the four-position reversing valve is at the first station, at this moment, oil enters the small cavity of the bulldozing blade oil cylinder and returns from the large cavity, and the bulldozing blade is controlled to ascend;

when the pilot pressure is controlled to be at a second stage which is greater than the ultimate positioning set value, the bulldozing pilot valve enters an ultimate positioning mode, pilot oil enters the port b via the port 1 of the bulldozing pilot valve to push the valve spool of the four-position reversing valve to move leftwards, the four-position reversing valve is at the third station, at this moment, the small-cavity A port and the large-cavity B port of the bulldozing blade oil cylinder are communicated with the oil tank, and the bulldozing blade floating function is realized.

Further, the bulldozing hydraulic system further comprises a pilot pressure feedback line and a load pressure feedback line;

the pilot pressure feedback line and the load pressure feedback line are communicated with a pressure feedback port PL of the load-sensitive pump by means of a shuttle valve, and the shuttle valve and a port LS of the load-sensitive valve are communicated with the load pressure feedback line;

the shuttle valve and a port b of the four-position reversing valve are communicated with the pilot pressure feedback line, and the port T of the load-sensitive valve is communicated with the oil tank;

when an excavator enables the floating function to perform trench backfilling and field leveling, a load pressure PLS is greater than a pilot pressure Pbls, a port LS of the load pressure feedback line is communicated with the port PL of the load-sensitive pump to guarantee load pressure feedback in a normal condition, and pressure and flow outputs of the load-sensitive pump are controlled;

when the excavator is in an idling condition, the pilot pressure Pbls is greater than the load pressure PLS, a port bls of the pilot pressure feedback line is communicated with the port PL of the load-sensitive pump, an output pressure of the load-sensitive pump is controlled to be greater than a pilot pressure of the four-position reversing valve at the third station to maintain the four-position reversing valve at the third station, and the small-cavity A port and the large-cavity B port of the bulldozing blade oil cylinder are communicated with the oil tank, such that the bulldozing blade floating function is realized.

Further, the large-cavity B port of the bulldozing blade oil cylinder is communicated with a port B1 of the load-sensitive valve, the small-cavity A port of the bulldozing blade oil cylinder is communicated with a port A1 of the load-sensitive valve, and the port P of the load-sensitive pump is communicated with a port P1 of the load-sensitive valve.

Further, the station switching mechanism comprises an electric-control bulldozing handle, a controller, a first pilot solenoid valve and a second pilot solenoid valve, and the controller determines a current state of the handle according to a signal output by the electric-control bulldozing handle and then controls the first pilot solenoid valve and the second pilot solenoid valve to push the four-position reversing valve to switch the station so as to realize ascending, descending and floating of the bulldozing blade.

Further, the first pilot solenoid valve and the second pilot solenoid valve are communicated with a port a and a port b of the four-position reversing valve respectively;

when the electric-control bulldozing handle is located at a neutral position, the controller has no output, and the four-position reversing valve is located at the neutral position;

when the electric-control bulldozing handle outputs a port a control signal, the controller controls the first pilot solenoid valve to be turned on to push the four-position reversing valve to the first station, the large-cavity B port of the bulldozing blade oil cylinder is communicated with the oil tank, at this moment, oil enters a small cavity of the bulldozing blade oil cylinder and returns from a large cavity, and the bulldozing blade ascends;

when the electric-control bulldozing handle outputs a port b control signal, the controller controls an opening of the second pilot solenoid valve to push the four-position reversing valve to the second station, the small-cavity A port of the bulldozing blade oil cylinder is communicated with the oil tank, at this moment, oil enters the large cavity of the bulldozing blade oil cylinder and returns from the small cavity, and the bulldozing blade descends;

when the electric-control bulldozing handle outputs a bulldozing floating signal, the controller controls the opening of the second pilot solenoid valve to push the four-position reversing valve to the third station, at this moment, the small-cavity A port and the large-cavity B port of the bulldozing blade oil cylinder are communicated with the oil tank, and the bulldozing blade floating function is enabled.

The invention provides an excavator, comprising an excavator body and the bulldozing hydraulic system with a bulldozing blade floating function as described above, and the bulldozing hydraulic system is arranged on the excavator body.

The invention has the following beneficial effects:

The invention solves the problem that an existing excavator bulldozing blade does not have a floating function; a reversing valve integration mode is adopted, such that a high-voltage electromagnetic reversing hydraulic element does not need to be externally connected between the reversing valve and the bulldozing blade oil cylinder; and due to element integration, the space is saved, and the cost is reduced.

DETAILED DESCRIPTION OF THE INVENTION

Figure 1:
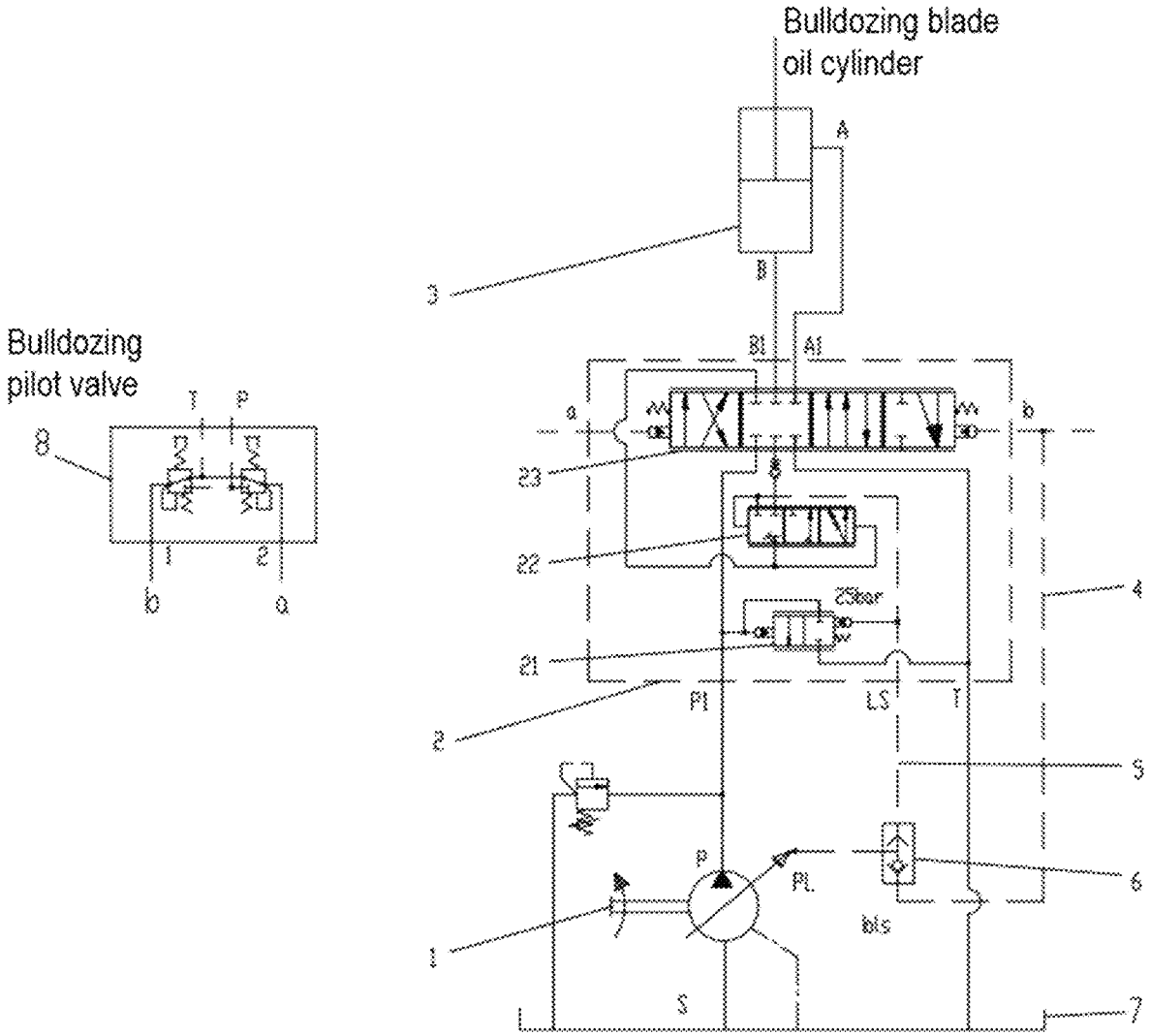
FIG. 1 is a first hydraulic principle diagram of a bulldozing hydraulic system with a bulldozing blade floating function according to one embodiment of the invention.
Figure 2:
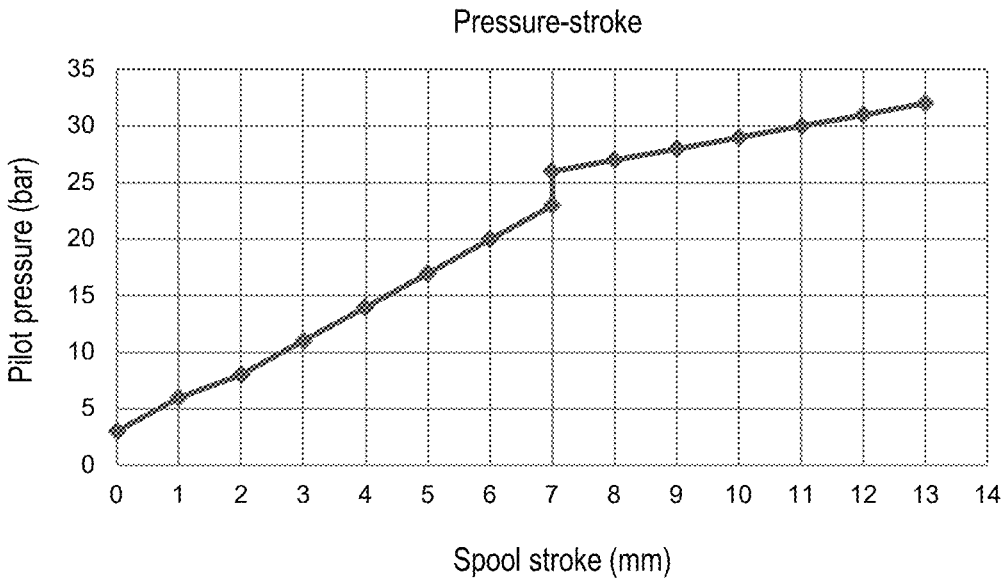
FIG. 2 is a pressure-stroke control curve chart of a port b of a four-position reversing valve of the bulldozing hydraulic system with a bulldozing blade floating function according to one embodiment of the invention.
Figure 3:
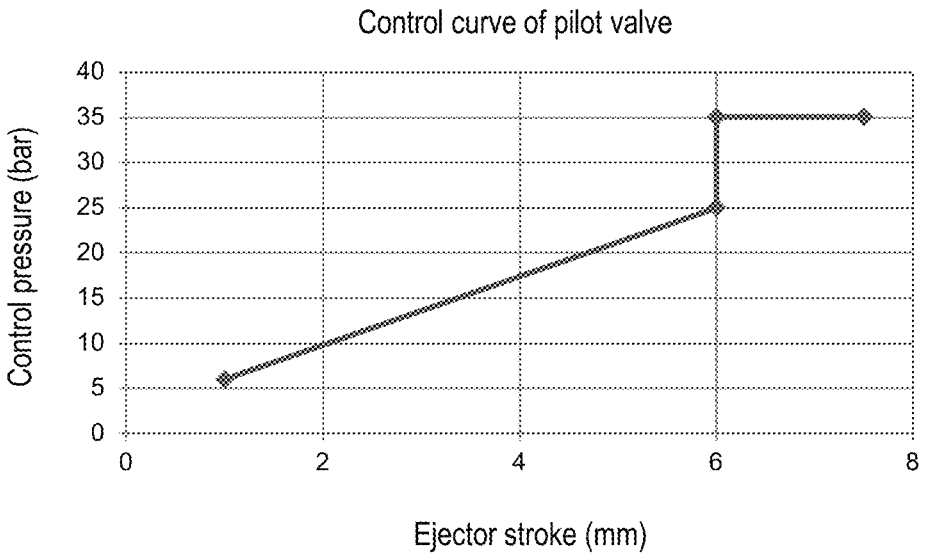
FIG. 3 is a pressure-ejector stroke control curve chart of a port 1 of a bulldozing pilot valve of the bulldozing hydraulic system with a bulldozing blade floating function provided by one embodiment of the invention.

The technical solution of the invention is described in further detail below in conjunction with the accompanying drawings:

Referring to FIG. 1-FIG. 3, the invention provides a bulldozing hydraulic system with a bulldozing blade floating function, comprising a load-sensitive pump 1, a load-sensitive valve 2, a bulldozing blade oil cylinder 3, a bulldozing pilot valve 8 and a feedback line, wherein the load-sensitive valve 2 comprises a four-position reversing valve 23, a pressure compensating valve 22 and an unloading valve 21, the load-sensitive pump 1 comprises a plunger pump and a load feedback and control device, the bulldozing blade oil cylinder 3 comprises a large cavity and a small cavity, the bulldozing pilot valve 8 has a single-side ultimate positioning function, the feedback line comprises a shuttle valve 6, a load pressure feedback line 5 and a pilot pressure feedback line 4, a large-cavity B port of the bulldozing blade oil cylinder is communicated with a port B1 of the load-sensitive valve, a small-cavity A port of the bulldozing blade oil cylinder is communicated with a port A1 of the load-sensitive valve, a port P of the load-sensitive pump is communicated with a port P1 of the load-sensitive valve, the shuttle valve 6 is communicated with a pressure feedback port PL of the load-sensitive pump, the load pressure feedback line 5 is communicated with the shuttle valve 6 and a port LS of the load-sensitive valve, the pilot pressure feedback line 4 is communicated with the shuttle valve 6 and a pilot port b of the four-position reversing valve, a port 1 and a port 2 of the bulldozing pilot valve are communicated with a port a and a port b of the four-position reversing valve respectively, and a port T of the load-sensitive valve is communicated with an oil tank 7. If the four-position reversing valve 23 is at a left station, that is, the port P of the load-sensitive pump is communicated with the small-cavity A port of the bulldozing blade oil cylinder 3 and the large-cavity B port of the bulldozing blade oil cylinder 3 is communicated with the oil tank 7, oil enters the small cavity of the bulldozing blade oil cylinder 3 and returns from the large cavity. If the four-position reversing valve 23 is at a first right station, that is, the port P of the load-sensitive pump is communicated with the large-cavity B port of the bulldozing blade oil cylinder 3 and the small-cavity A port of the bulldozing blade oil cylinder 3 is communicated with the oil tank 7, oil enters the large cavity of the bulldozing blade oil cylinder 3 and returns from the small cavity. If the four-position reversing valve 23 is at a second right station, that is, the small-cavity A port and the large-cavity B port of the bulldozing blade oil cylinder 3 are communicated with the port T of the load-sensitive valve, the large cavity and the small cavity of the bulldozing blade oil cylinder 3 are communicated with the oil tank, and the bulldozing blade floating function is enabled, thus improving the working efficiency of an excavator used for trench backfilling and field leveling.

The bulldozing pilot valve 8 is a hydraulic-control pilot valve, has a single-side ultimate positioning function and can lock and control an ultimate pressure.

The four-position reversing valve 23 is configured to control a pilot pressure output by the bulldozing pilot valve to realize reversing of the reversing valve.

In the invention, the bulldozing hydraulic system comprises the load-sensitive pump 1, the bulldozing blade oil cylinder 3 and the four-position reversing valve 23, the load-sensitive pump 1 outputs high-pressure oil according to load pressure feedback and is communicated with the small-cavity A port or the large-cavity B port of the bulldozing blade oil cylinder 3 by means of the four-position reversing valve 23, and the four-position reversing valve 23 can be controlled to reverse to control a bulldozing blade to ascend, descend or float.

In the bulldozing hydraulic system, the correspondence between the pilot pressure and the spool stroke of the four-position reversing valve 23 is shown in FIG. 2; when the pilot pressure is at a first stage which is 0-25 bar, a valve spool of the four-position reversing valve 23 is controlled to be located at the left station or the first right station to realize ascending or descending of the bulldozing blade. When the pilot pressure is at a second stage which is greater than 25 bar, the valve spool is controlled to be located at the second right station to realize floating of the bulldozing blade.

The bulldozing hydraulic system further comprises the bulldozing pilot valve 8, and the correspondence between the control pressure and the ejector stroke of the port 1 of the bulldozing pilot valve is shown in FIG. 3. When the ejector stroke of the bulldozing pilot valve is 0-6 mm, the pilot pressure is controlled to be 0-25 bar; and when the ejector stroke of the bulldozing pilot valve is greater than 6 mm, ultimate positioning is performed, and the pilot pressure is controlled to be greater than 25 bar. When the pilot pressure is controlled to be at the first stage which is 0-25 bar, pilot oil enters the port b via the port 1 of the pilot valve to push the valve spool to move leftwards, the four-position reversing valve 23 is at the first right station, at this moment, oil enters the large cavity of the bulldozing blade oil cylinder 3 and returns from the small cavity; then, the pilot oil enters the port a via the port 2 of the pilot valve to push the valve spool to move rightwards, the four-position reversing valve 23 is at the left station, and at this moment, oil enters the small cavity of the bulldozing blade oil cylinder 3 and returns from the large cavity. When the pilot pressure is controlled to be at the second stage which is greater than 25 bar, the bulldozing pilot valve 8 enters an ultimate positioning mode, pilot oil enters the port b via the port 1 of the pilot valve to push the valve spool to move leftwards, the four-position reversing valve 23 is at the second right station, and at this moment, the small-cavity A port and the large-cavity B port of the bulldozing blade oil cylinder 3 are communicated with the port T of the oil tank, thus realizing the bulldozing blade floating function.

The bulldozing hydraulic system further comprises the pilot pressure feedback line 4 and the load pressure feedback line 5, and the pilot pressure feedback line 4 and the load pressure feedback line 5 are communicated with the pressure feedback port PL of the load-sensitive pump 1 by means of the shuttle valve 6. When an excavator enables the floating function to perform trench backfilling and field leveling, the load pressure PLS is greater than the pilot pressure Pbls, a port LS of the load pressure feedback line 5 is communicated with the port PL of the load-sensitive pump 1 to guarantee load pressure feedback in a normal condition, and pressure and flow outputs of the load-sensitive pump 1 are controlled. When the excavator is in an idling condition, the pilot pressure Pbls is greater than the load pressure PLS, a port bls of the pilot pressure feedback line 4 is communicated with the port PL of the load-sensitive pump 1, the output pressure of the load-sensitive pump 1 is controlled to be greater than the pilot pressure of the four-position reversing valve 23 at the second right station to maintain the four-position reversing valve 23 at the second right station, and the small-cavity A port and large-cavity B port of the bulldozing blade oil cylinder 3 are communicated with the port T of the oil tank to keep the bulldozing blade floating function.

Figure 4:
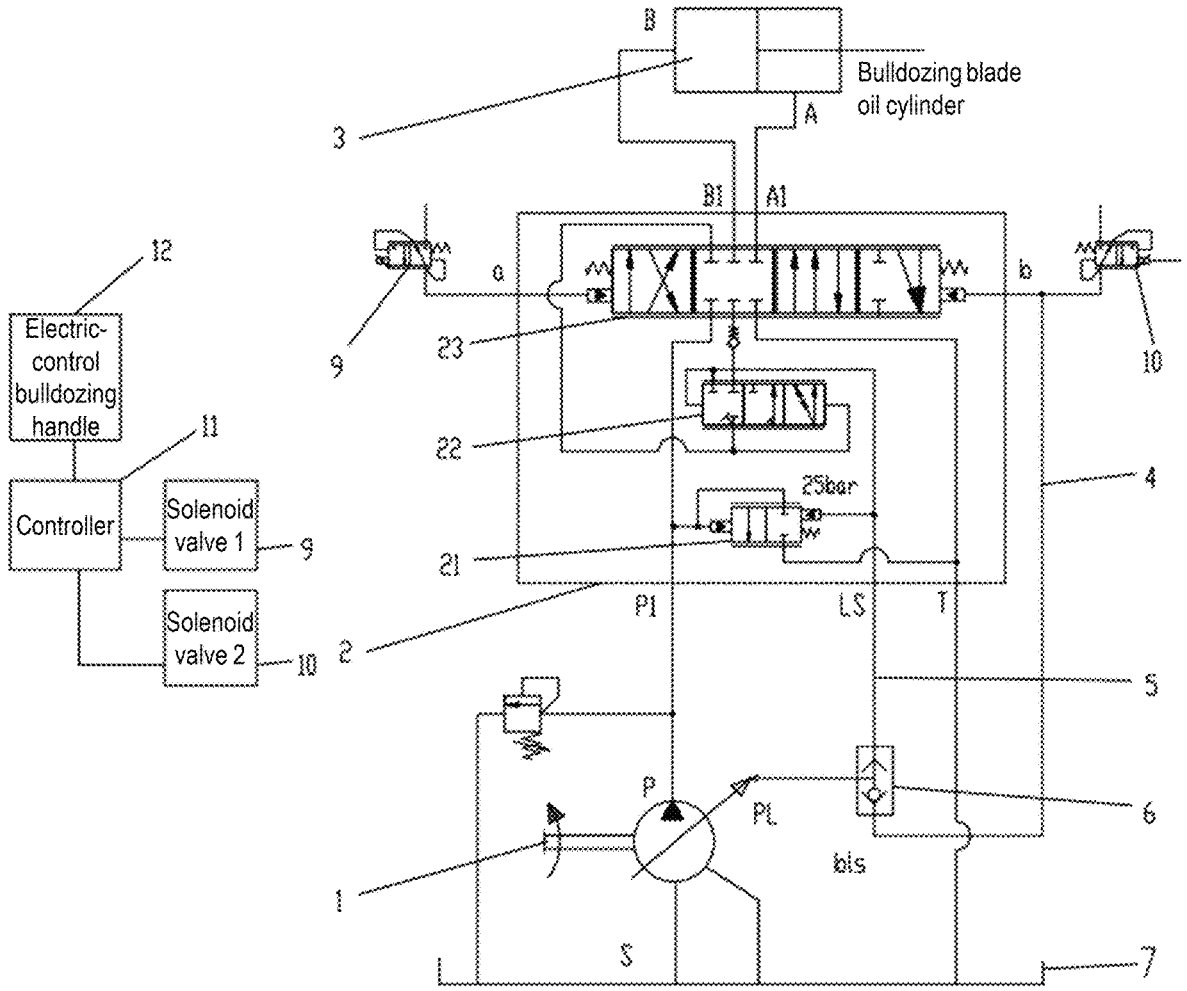
FIG. 4 is a second hydraulic principle diagram of the bulldozing hydraulic system with a bulldozing blade floating function according to one embodiment of the invention.

Referring to FIG. 4, pilot hydraulic control in the invention can be replaced with electric control. Specifically, an electric-control bulldozing handle 12 is used, and a controller 11 determines a current state of the handle according to a signal output by the electric-control bulldozing handle 12 and then controls a first pilot solenoid valve 9 and a second pilot solenoid valve 10 to push the four-position reversing valve 23 to move to realize ascending, descending and floating of the bulldozing blade.

When the electric-control bulldozing handle 12 is located at a neutral position, the controller 11 has no output, and the four-position reversing valve 23 is at a neutral position.

When the electric-control bulldozing handle 12 outputs a port a control signal, the controller 11 controls the first pilot solenoid valve 9 to be turned on to push the four-position reversing valve 23 to the left station, that is, the port P of the pump is communicated with the small-cavity A port of the bulldozing blade oil cylinder and the large-cavity B port of the bulldozing blade oil cylinder is communicated with the oil tank, at this moment, oil enters the small cavity of the bulldozing blade oil cylinder and returns from the large cavity, and the bulldozing blade ascends.

When the electric-control bulldozing handle 12 outputs a port b control signal and does not output a bulldozing floating signal, the controller 11 controls an opening of the second pilot solenoid valve 10 to push the four-position reversing valve 23 to the first right station, that is, the port P of the pump is communicated with the large-cavity B port of the bulldozing blade oil cylinder and the small-cavity A port of the bulldozing blade oil cylinder is communicated with the oil tank, at this moment, oil enters the large cavity of the bulldozing blade oil cylinder and returns from the small cavity, and the bulldozing blade descends.

When the electric-control bulldozing handle 12 outputs a bulldozing floating signal, the controller 11 controls the opening of the second pilot solenoid valve 10 to push the four-position reversing valve 23 to the second right station, that is, the small-cavity A port and the large-cavity B port of the bulldozing blade oil cylinder are communicated with the port T, and the bulldozing blade floating function is enabled.

In the invention, state (ascending, descending or floating) signals of the electrical-control bulldozing handle 12 acquired by the controller are not limited to common PWM signals and may be any signals that can accurately recognize the current working state of the electrical-control bulldozing handle. When the controller 11 controls the second pilot solenoid valve 10, the controller 11 can control the opening of the second pilot solenoid valve 10 to push the four-position reversing valve 23 to the first or second right station. The pressure-stroke control curve of the port b is shown in FIG. 2.

Preferred embodiments of the invention are specifically described above. Of course, the invention can also be implemented as embodiments different from the embodiments described above. All equivalent transformations or corresponding variations made by any skilled in the art without departing from the spirit of the invention should fall within the protection scope of the invention.

What is claimed is:

1. A bulldozing hydraulic system with a bulldozing blade floating function, comprising a load-sensitive pump, a bulldozing blade oil cylinder, a load-sensitive valve and a station switching mechanism, wherein:

the load-sensitive valve comprises a four-position reversing valve;

the four-position reversing valve at least has a first station, a second station and a third station which are switchable;

when the four-position reversing valve is at the first station, a port P of the load-sensitive pump is communicated with a small-cavity A port of the bulldozing blade oil cylinder, a large-cavity B port of the bulldozing blade oil cylinder is communicated with an oil tank, oil enters the small-cavity A port of the bulldozing blade oil cylinder and returns from the large-cavity B port, and a bulldozing blade is controlled to ascend;

when the four-position reversing valve is at the second station, the port P of the load-sensitive pump is communicated with the large-cavity B port of the bulldozing blade oil cylinder, the small-cavity A port of the bulldozing blade oil cylinder is communicated with the oil tank, oil enters the large-cavity B port of the bulldozing blade oil cylinder and returns from the small-cavity A port, and the bulldozing blade is controlled to descend;

when the four-position reversing valve is at the third station, the small-cavity A port and the large-cavity B port of the bulldozing blade oil cylinder are communicated with a port T of the load-sensitive valve, and the small-cavity A port and the large-cavity B port of the bulldozing blade oil cylinder are communicated with the oil tank, such that the bulldozing blade floating function is realized;

the station switching mechanism is configured to select and switch the stations of the four-position reversing valve according to a load pressure feedback or a handle signal output;

wherein the station switching mechanism comprises a bulldozing pilot valve, a port 1 of the bulldozing pilot valve and a port 2 of the bulldozing pilot valve are communicated with a port a of the four-position reversing valve and a port b of the four-position reversing valve respectively;

when a pilot pressure is controlled to be at a first stage which is between 0 and an ultimate positioning set value, pilot oil enters the port b via the port 1 of the bulldozing pilot valve to push a valve spool of the four-position reversing valve to move leftwards, the four-position reversing valve is at the second station, at this moment, oil enters a large cavity of the bulldozing blade oil cylinder and returns from a small cavity of the bulldozing blade oil cylinder, and the bulldozing blade is controlled to descend;

the pilot oil enters the port a via the port 2 of the bulldozing pilot valve to push the valve spool of the four-position reversing valve to move rightwards, the four-position reversing valve is at the first station, at this moment, oil enters the small cavity of the bulldozing blade oil cylinder and returns from the large cavity, and the bulldozing blade is controlled to ascend;

when the pilot pressure is controlled to be at a second stage which is greater than the ultimate positioning set value, the bulldozing pilot valve enters an ultimate positioning mode, the pilot oil enters the port b via the port 1 of the bulldozing pilot valve to push the valve spool of the four-position reversing valve to move leftwards, the four-position reversing valve is at the third station, at this moment, the small-cavity A port and the large-cavity B port of the bulldozing blade oil cylinder are communicated with the oil tank, and the bulldozing blade floating function is realized.

2. The bulldozing hydraulic system with the bulldozing blade floating function according to claim 1, wherein the bulldozing hydraulic system further comprises a pilot pressure feedback line and a load pressure feedback line;

the pilot pressure feedback line and the load pressure feedback line are communicated with a pressure feedback port PL of the load-sensitive pump by means of a shuttle valve, and the shuttle valve and a port LS of the load-sensitive valve are respectively communicated with the load pressure feedback line;

the shuttle valve and the port b of the four-position reversing valve are respectively communicated with the pilot pressure feedback line, and the port T of the load-sensitive valve is communicated with the oil tank;

when an excavator enables the floating function to perform trench backfilling and field leveling, a load pressure PLS is greater than a pilot pressure Pbls, a port LS of the load pressure feedback line is communicated with the pressure feedback port PL of the load-sensitive pump to guarantee the load pressure feedback in a normal condition, and pressure and flow outputs of the load-sensitive pump are controlled;

when the excavator is in an idling condition, the pilot pressure Pbls is greater than the load pressure PLS, a port bls of the pilot pressure feedback line is communicated with the pressure feedback port PL of the load-sensitive pump, an output pressure of the load-sensitive pump is controlled to be greater than the pilot pressure of the four-position reversing valve at the third station to maintain the four-position reversing valve at the third station, and the small-cavity A port and the large-cavity B port of the bulldozing blade oil cylinder are communicated with the oil tank, such that the bulldozing blade floating function is realized.

3. The bulldozing hydraulic system with the bulldozing blade floating function according to claim 1, wherein the large-cavity B port of the bulldozing blade oil cylinder is communicated with a port B1 of the load-sensitive valve, the small-cavity A port of the bulldozing blade oil cylinder is communicated with a port A1 of the load-sensitive valve, and the port P of the load-sensitive pump is communicated with a port P1 of the load-sensitive valve.

4. The bulldozing hydraulic system with the bulldozing blade floating function according to claim 1, wherein the station switching mechanism comprises an electric-control bulldozing handle, a controller, a first pilot solenoid valve and a second pilot solenoid valve, and the controller determines a current state of the electric-control bulldozing handle according to a signal output by the electric-control bulldozing handle and then controls the first pilot solenoid valve and the second pilot solenoid valve to push the four-position reversing valve to switch the station so as to realizing ascending, descending and floating of the bulldozing blade.

5. The bulldozing hydraulic system with the bulldozing blade floating function according to claim 4, wherein the first pilot solenoid valve and the second pilot solenoid valve are communicated with the port a of the four-position reversing valve and the port b of the four-position reversing valve respectively;

when the electric-control bulldozing handle is located at a neutral position, the controller has no output, and the four-position reversing valve is located at the neutral position;

when the electric-control bulldozing handle outputs a port a control signal, the controller controls the first pilot solenoid valve to be turned on to push the four-position reversing valve to the first station, the large-cavity B port of the bulldozing blade oil cylinder is communicated with the oil tank, at this moment, oil enters the small cavity of the bulldozing blade oil cylinder and returns from the large cavity of the bulldozing blade oil cylinder, and the bulldozing blade ascends;

when the electric-control bulldozing handle outputs a port b control signal, the controller controls an opening of the second pilot solenoid valve to push the four-position reversing valve to the second station, the small-cavity A port of the bulldozing blade oil cylinder is communicated with the oil tank, at this moment, oil enters the large cavity of the bulldozing blade oil cylinder and returns from the small cavity, and the bulldozing blade descends;

when the electric-control bulldozing handle outputs a bulldozing floating signal, the controller controls the opening of the second pilot solenoid valve to push the four-position reversing valve to the third station, at this moment, the small-cavity A port and the large-cavity B port of the bulldozing blade oil cylinder are communicated with the oil tank, and the bulldozing blade floating function is enabled.

6. An excavator, comprising an excavator body and the bulldozing hydraulic system with the bulldozing blade floating function according to claim 1, wherein the bulldozing hydraulic system is arranged on the excavator body.

* * * * *